United States Patent [19]

Wiarda

[11] 4,098,005

[45] Jul. 4, 1978

[54] VAPOR DEGREASER

[76] Inventor: Johannes Ymer Wiarda, De Deel 15, Kamerik, Netherlands

[21] Appl. No.: 747,174

[22] Filed: Dec. 3, 1976

[30] Foreign Application Priority Data

Dec. 4, 1975 [NL] Netherlands ..... 7514181

[51] Int. Cl.[2] ..... F26B 21/14

[52] U.S. Cl. ..... 34/73; 34/78; 34/37; 134/11; 134/31; 202/180

[58] Field of Search ..... 34/73, 75, 76, 77, 78, 34/36, 37; 134/11, 31; 202/185 A, 185 E, 180, 202

[56] References Cited

U.S. PATENT DOCUMENTS

| | | | |
|---|---|---|---|
| 1,613,073 | 1/1927 | Zimmerli | 34/73 |
| 2,123,439 | 7/1938 | Savage | 134/11 |
| 3,166,445 | 1/1965 | Enemark et al. | 34/36 |
| 4,032,033 | 6/1977 | Chu et al. | 134/11 |

FOREIGN PATENT DOCUMENTS

| | | | |
|---|---|---|---|
| 670,631 | 9/1963 | Canada | 134/11 |
| 1,214,210 | 10/1958 | France | 134/11 |
| 2,098,576 | 10/1972 | France | 134/11 |
| 12,759 | 7/1880 | Fed. Rep. of Germany | 34/78 |

*Primary Examiner*—John J. Camby
*Assistant Examiner*—Larry I. Schwartz
*Attorney, Agent, or Firm*—Marshall & Yeasting

[57] ABSTRACT

Vapor degreasing apparatus comprising a tank having in its lower part a heatable reservoir for a solvent for fats, oils, lubricants or the like, and having, above said reservoir, a vapor space adapted for introducing therein metal articles or machine parts to be degreased. Cooling water piping is provided in the upper part of the tank, said piping comprising a section which functions as a heat exchanger for incoming heat released during the vapor-liquid conversion of the solvent while forming a vapor escape barrier for retaining, through condensation, the solvent vapor, said piping also comprising a section which functions as a heat exchanger for outgoing heat to the ambient air. A gutter is provided below the heat exchangers for catching the condensate, a pump is connected to the cooling water piping for circulating the water and air exhaust means is provided in the uppermost part of the tank for exhausting threads of vapor, if any, passing the vapor escape barrier, and for cooling that section of the cooling water piping which functions as the heat exchanger for said outgoing heat to the ambient air. A water jacket is provided in which the cooling water piping which functions as the heat exchanger for incoming heat is positioned. The cooling water piping is formed as a closed circuit without direct communication between the water coolant and the air of the outgoing heat exchanger.

7 Claims, 4 Drawing Figures

VAPOR DEGREASER

Vapour degreasers are used to strip metal articles or machine parts of oil or greasy substances. These substances are remnants of the "lubricant" used during the cutting operation of new articles or machine parts. Articles or machine parts already existing and having become, during their use, dirty and greasy, are degreased in other cleaning machines, specially designed for that purpose.

In the vapour degreasers, the articles or machine parts to be cleaned are suspended in the vapour of an organic solvent in which the vapour condenses onto the cold metal surfaces and the condensate drains from the articles, taking along the fat. This process continues until the temperature of the article has increased such that no condensate is formed any longer. By that time the article is clean and is removed from the vapour above the solvent bath. Hereafter the article or machine part is ready for the mounting process in which it together with other machine parts is utilized for assembling a machine or the like, or to be processed further. The continued processing of these articles requires that these parts be free from grease or that they are protected by another preservative. Also prior to coating said machine parts with a lacquer, they should be free of grease.

The apparatus for degreasing such machine parts consists generally of a vertically arranged container or tank, square or rectangular, sometimes cylindrical in cross section, having a lower liquid reservoir, in which is provided an organic solvent being heated by appropriate means. The section of a tank above the liquid reservoir is the vapour space, in which the machine parts to be degreased are introduced. In order to bring the articles rapidly and easily into and out of the container, the latter should in operation be open at its top. In this manner vapour can escape and partly for sanitary, partly for economical reasons, this should be obviated. In connection therewith the tank in its non-operative condition is closed at its top by a lid.

To prevent in operation when the tank is open the undesirable escape of vapour it was customary in the past to provide around the upper part of the tank a water cooling, for example by way of a cooling coil, whose task was to lower the temperature at the upper part of the tank such that the vapour is precipitated thereon while forming a condensate. The solvent thus restored into the liquid state drips from the cooling coil and is collected in a gutter arranged below the cooling coil. From there it is recycled through a pipe to the liquid reservoir. The cooling coil was provided close to and along the four sides of the tank wall in order not to impede the introduction and removal of the machine parts to be degreased. The cooling water used in an installation of moderate sizes was about 200 liters per hour. Meanwhile the operation of that cooling zone was so effective that the vapour normally did not exceed the second winding of the coil (counted from below). Cooling water has here a large cooling area. Nevertheless by convection currents (chimney effect) due to the temperature difference between the center of the vapour space and the higher exterior atmosphere, vapour threads or curls can escape so that the apparatus does not function entirely odourless. The amounts, in which vapour threads succeed in escaping, depend to a high degree on the solvent being applied and the condition of rest of ambient air (open windows and/or doors and/or exhaust systems or like apparatus). The three solvents most commonly used for degreasing metals are:

perchloro ethylene (PER): boiling point 121° C
trichloro ethylene (TRI): boiling point 87° C
1.1.1. trichloro ethane (1.1.1.TRI): boiling point 74° C.

A possible solution for this problem could be to exhaust rigorously said vapour threads by means of an exhaust system arranged above the cooling coil, the transverse size of this system being likewise restricted to a narrow zone close to the circumference of the tank. The air thus exhausted does not rise appreciably in temperature (about 0.5° to 1° C.) by the contact with the vapour threads, so remains cool and can therefore be used perfectly for cooling down the vapour escape barrier situated just above the vapour space. As a result the cooling coil, continuously fed with cold water, being hitherto used can be replaced, although in order to obtain the same cooling efficiency as with water, extremely large quantities of air must be exhausted from the ambient atmosphere, or otherwise the cooling area must be extremely enlarged. This development has resulted in a vapour degreaser in which as coolant use is made exclusively of air, said air also serving to timely exhaust vapour threads being on the verge of escaping to prevent their issuing into the working space. Apart from the large quantities of air being necessary, there is still another objection against this arrangement, as follows.

Certain "lubricants" being applied in the cutting operation of metals, are emulsions of water and oil. The articles being produced through such a cutting operation, such as screws, nuts and bolts manufactured on a turret-lathe, are generally dripping with the drilling fluid and when they have been suspended into the vapour space, for example within a basket, this water oil together with the solvent condensed onto the cold article falls back for the greater part directly into the liquid reservoir in the form of a liquid rain. The oil component of the emulsion has already dissolved into the solvent during the cleaning process and gets in this way into the boiling solvent within the liquid reservoir. The water component of the emulsion gets in the same way into the liquid bath.

Under some circumstances, i.e., in highly contaminated installations, problems may occur. For, if cleaning of the liquid reservoir is not done timely, a thick mud layer of oil containing dirt which during the vapour degreasing process would come together with the solvent condensate into the liquid bath, would settle on the heating tubes in the reservoir. This layer may cover large parts of said tubes, causing a strong increase of the temperature due to insufficient heat dissipation to the solvent. As a result the oil in this dirt would smoke and even would take fire. Accordingly at these elevated temperatures certain ion splittings could be provoked in this dirt layer likewise being impregnated with solvent.

If there is also water on the liquid level (specific weight water < specific weight solvent) this water can react with the ions split off while forming whether or not volatile aggressive substances which could affect the articles just degreased and in the long run even the stainless steel heating tubes and also other parts of the apparatus, which of course is undesirable.

Among the three solvents most commonly used only PER is able, since its boiling point (121° C) is above that of water, to expel quickly the water from the solvent liquid level, namely in the vapour state, without having in the liquid state the opportunity to form with free ions in the liquid bath aggressive compounds. The water in the drilling fluid is therefore, while boiling, rapidly expelled from the bath in the vapour state, but precipitates progressively against the cooling walls and is collected in the gutter, whence it returns to the liquid reservoir indirectly together with the solvent vapour being likewise condensed against the cooling walls, from where it re-evaporates quickly, etc. So there occurs a continuous cycling of the water that in this manner cannot easily be removed from the apparatus. As a matter of fact high costs of energy are involved; however due to its short residence time in the liquid reservoir the water cannot cause undesirable reactions when applying PER as solvent. To get rid of water annoyance, the water collected in the gutter should be discharged from the apparatus. However, this water has been mixed with the solvent and should separated therefrom to prevent that in this manner important quantities of solvent would be lost. At the temperature the mixture has, the separation in a separator between the two phases runs extremely slow and this process can enhanced by a suitable cooling of the mixture. As in a purely air operated installation the cooling effect is not great, the separation process lasts undesirably long. In practice therefore no separator is used with a vapor degreaser only working with air and the water is therefore kept continuously in the system. A further disadvantage of the known vapour degreaser working only with air is therefore that the selection of a solvent is a restricted one.

To obtain good results despite the choice of the solvent, the water originating from the drilling fluid should be expelled from the liquid bath in another way and should be removed from the apparatus permanently rather than through the almost endless way of evaporating, condensing, evaporating, etc. To this end in the known water cooled apparatus a separator was already arranged near said apparatus to bring about a separation — based upon the difference in specific weight — between the mixture collected in the gutter of water originating from the "greasing"-emulsion applied during the cutting operation and liquid solvent condensate. A certain quantity of this emulsion water will drop in the dripping off stage directly into the liquid bath and then evaporate in combination with the solvent (also with solvents having a boiling point lower than 100° C). Solvent and water vapour condense then together against the condensation wall and both of them collect in the gutter. The more the boiling point of the solvent is below that of water, the greater the residence time of water on the liquid bath is, which can have undesirable results, as indicated hereabove. The residence time should be shortened and therefore the mixture collected in the gutter should not be returned to the bath again, since otherwise the residence time would be almost unlimited with all the evil results thereof. Therefore the water of the mixture collected in the gutter must be separated and to permit this separation process to run effectively, the mixture in the separator should be cooled down relatively strong. To this end the gutter is connected exteriorly to the closed circuit of the cooling fluid. The separator is interiorly connected to the so called condensate gutter. Although all of the solvents used have a specific weight differing relatively sharp from that of water, this separation could last infinitesimally long without special measures. At lower temperatures, however, the separating effect increases. Therefore this behavior is promoted by using the water for cooling down the vapour barrier zone also for cooling down the separator in the same closed circuit.

The primary object of the present invention is to provide an apparatus in which the disadvantages of the known apparatus have been eliminated but its advantages are maintained.

A second object of the invention is to provide an apparatus in which a complete freedom of choice of the solvent desired is possible.

Accordingly the invention provides a vapour degreasing apparatus comprising a tank having in its lower part a heatable reservoir for a solvent for fats, oils, lubricants or the like, and having, above said reservoir, a space serving as vapour space and adapted for introducing therein metal articles for machine parts to be degreased, a cooling water piping being provided in the upper part of the tank, said piping comprising a section which functions as a heat exchanger for incoming heat released during the vapour-liquid conversion of the solvent while forming a vapour escape barrier for retaining through condensation the solvent vapour, said piping also comprising a section which functions as a heat exchanger for outgoing heat to the ambient air, a gutter being provided below the heat exchangers for catching the condensate, a pump connected to the cooling water piping for circulating the water coolant, air exhaust means being provided in the uppermost part of the tank for exhausting threads of vapour, if any, passing the vapour escape barrier, and for cooling down that section of the cooling water piping which functions the heat exchanger for said outgoing heat and a double walled water jacket in which the cooling water piping which functions as the heat exchanger for incoming heat is positioned, the cooling water piping being formed as a closed circuit without direct communication between the water coolant and the air of the outgoing heat exchanger. In the double walled jacket only the incoming heat exchanger is incorporated, and the lower part of the inner wall of the double walled jacket is slanted outwards forming a recess for accommodating the gutter.

Preferably the inner wall of the jacket acting as condensation wall is smooth on the side facing the interior of the tank. The heat exchanger for outgoing heat is mounted in double fashion within the exhaust margin along the long sides of the tank and serves for cooling the warmed cooling water by means of the exhaust air. Through the separator which, as described before, is also cooled, the coolant is recycled again in the lower part within the cooling jacket, this completing the cooling water circuit.

Therefore in the apparatus according to the invention a) air is primarily applied for exhausting possible escaping vapour, the quantity used being less than in the known apparatus exclusively working with air; secondly, air is passed over the exchanger for outgoing heat with large cooling area and is further discharged. b) water for cooling the so called vapour barrier zone is passed through said exchanger for incoming heat, where it absorbs the condensation heat, and is cooled by the exhausted air in the exchanger for outgoing heat, where it releases this heat.

Owing to the combination of these measures the cooling water need not constantly be refreshed and it can therefore flow in a closed circuit so that the consumption is nil. The double walled cooling jacket surface for the replacement of the usual cooling coil presents a smooth surface on the inner side of the tank. The baskets with machine parts are not hooked or otherwise engaged during introduction and removal. Preferably the lower end of the condensation wall is slanted while forming a recess for receiving the condensate gutter.

This slanting wall section forms preferably an angle of about 60° with the horizontal.

To optimize the cooling and in accordance wih a special feature of the invention the supply and discharge pipes of the cooling water circuit in the double walled cooling jacket are extended over the full length of the jacket and are provided with perforations. Advantageously the perforations in the pipes are shaped as saw-cuts, all being substantially provided in the lower half of said pipes. In this way a uniform cooling water shield will occur skimming the smooth inner side of the cooling jacket.

The water shield or curtain thus obtained flows from the bottom upwards, that means the inlet is mounted in the bottom portion and the outlet of the cooling water circuit is mounted in the upper portion of the double walled cooling jacket.

This effect can be intensified in that according to a further feature of the invention the saw-cuts in the lower pipe encompass, seen from the centre line of the pipe, an arc of about 120°, and the bisector of the arc angle is perpendicular to the slanting part of the condensation wall.

A further measure of the invention is that the separator on the other hand is connected exteriorly to the closed circuit of the coolant.

The vapour degreaser is protected in various ways, among other things by temperature controllers. For example one of the heating tubes in the liquid reservoir is at a slightly higher level than the other tubes and the top of this upper tube is provided with a sensor pipe of a thermostat so that not only the temperature in the liquid bath can be controlled but also the apparatus is protected against boiling dry.

In the wall of the tank there are two vertical superimposed thermostatic sensors substantially indicating the limits of the height of the vapour barrier. The lower thermostat is the vapour level controller proper. When the vapour level rises above the temperature sensor of the lower thermostat, the heating of the liquid reservoir is automatically switched off, whereas when the vapour level drops below said temperature sensor, the heating is automatically switched in again. The upper thermostat is an ultimate protection. If the vapour level rises beyond the upper temperature sensor, everything is automatically switched off and no automatic switching-in will take place if thereafter the vapour level drops down to below the lower temperature sensor.

The switching board is formed such that on putting the apparatus into operation the heating cannot be switched-in if the cooling system has not yet been started.

The invention will be better understood upon reading the following description of the invention in conjunction with the accompanying drawings, wherein FIG. 1 is a view in longitudinal section of the vapour degreaser according to the invention;

FIG. 2 a side elevational view;

Figure 1:
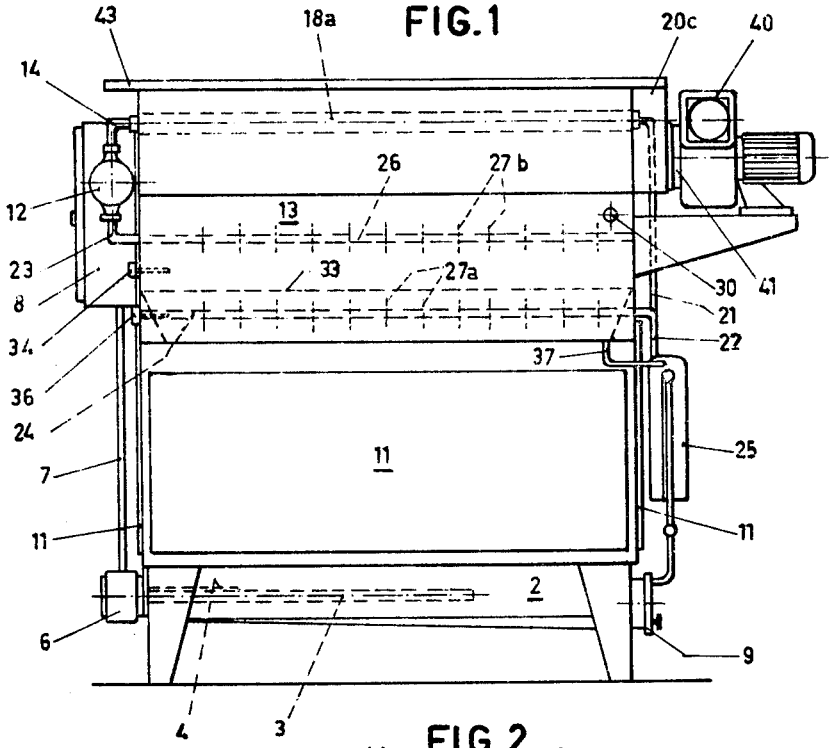

Referring now to the drawings and particularly to FIG. 1, the vapour degreaser has been shown as including a vertically disposed tank 1 of rectangular cross-section of stainless steel, having in its lower part a liquid reservoir 2 for receiving an organic solvent, in which reservoir a number of heating tubes 3 is inserted.

One of these tubes, namely tube 3*a*, is on a slightly higher level than the other tubes. Directly above the upper tube is a temperature sensor 4 of a thermostat protection against overheating and boiling-dry. The sensor 4 is accommodated in a thermostat housing 6 connected with its wiring through a pipe 7 to a switch- and control box 8. The overheating and boiling-dry thermostat protects the apparatus against overheating of the heating element for the liquid and against boiling-dry. On the side of the liquid reservoir 2 turned away from the thermostat housing 6 is provided a cleaning hatch.

Above the liquid reservoir 2 is a vapour space 10, and this part of the tank is therefore covered with insulation slabs 11.

Immediately above the space 10 is a vapour barrier or condensation zone 15, in which water is used as coolant, and above said barrier is an air box 20.

The cooling water system constitutes a closed circuit running partly through the condensation zone 15 and partly through the air box 20. It comprises a pump 12 for circulating the cooling water, a heat exchanger 13 for incoming heat connected to the suction side and a heat exchanger 18 for outgoing heat connected to the compression side of the pump 12. From the compression side of the pump the cooling water is pumped upwards through a rising pipe 14. At the end thereof the pipe is branched into two horizontal pipes 16*a, b* each opening in one of the horizontal heat exchangers 18*a, b* for outgoing heat, provided with fins 17 and extending along one of the two long sides of the tank. The ends of said exchangers 18*a, b* open in horizontal pipes 19*a, b*, whose ends are joined into a downcomer 21. The heat exchangers 18*a, b* and the branch pipes 19*a, b* are completely and the downcomer 21 is partly included within the air box 20. The cooling water in the downcomer 21 passes, after having traversed the cooling system of a separator 25, into a riser pipe 22, opening in the heat exchanger 13 for incoming condensation heat. After having traversed this heat exchanger the warmed cooling water enters into the pump 12 on the suction side through a pipe 23, which completes the cooling water circuit.

Figure 2:
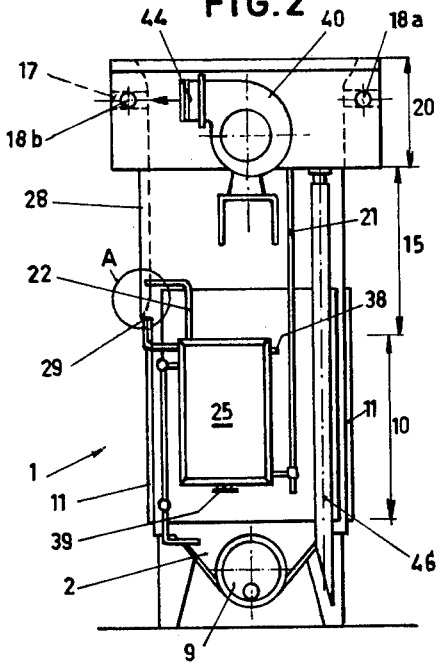
Figure 3:
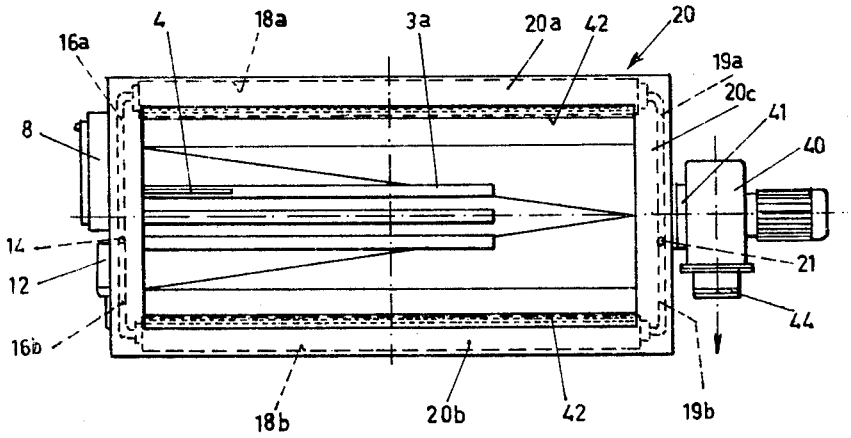
FIG. 3 is a top view thereof.

The heat exchanger 13 is constituted as a double walled jacket, in which are extended two horizontal pipes 24, 26. The pipes 24 and 26 are connected to the supply pipe 22 and the discharge pipe 23, respectively. The jacket 13 is filled with cooling water whose level is controlled by a level gauge 30; the pipes 24, 26 are in open communication with each other through a plurality of saw-cuts 27*a, b*. The wall 28 (FIGS. 2 and 4) of the jacket 13 facing the interior of the tank serves as a condensation wall, on which the vapour of the solvent and other vapours, if any, precipitate. For collecting the condensate, a gutter 29 is provided in the lower part of the wall 28 and to prevent this gutter from projecting into the inside dimensions of the tank 1, the lower part of the wall 28 has a slanting wall portion 28*a*, so that a recess is formed, in which the gutter 29 is received. The slanting angle of said wall portion 28*a* is about 60° with the horizontal. The vertical portion of the wall 28 is smooth so that the introduction and removal of the articles or machine parts to be cleaned is not impeded.

Figure 4:
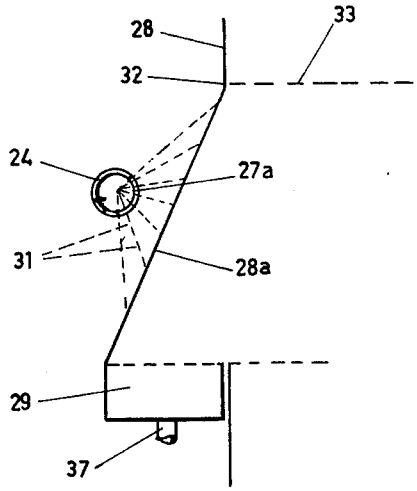
FIG. 4 is a cross section of the cooling jacket according to detail A in FIG. 2.

The saw-cuts 27, being provided in the two pipes 24, 26 substantially in the lower half of said pipes, are arranged particularly in the lower pipe 24 such that the bisector of the arc, spanning the saw-slits in the pipe 24, is perpendicular to the slanting wall portion 28*a* of the condensation wall 28. The cooling water ejecting from these saw-slits 27*a* constitutes a directed, longitudinally extending water spray cone 31 with an apex of about 120° (FIG. 4). This rain curtain gives an effective cooling of the vapour rising on the other side of the slanting condensation wall 28*a*, being hottest at that location. Owing to this the vapour will not be able to rise higher, so that about a location of the kink 32 in the condensation wall 28 the vapour end level 33 is formed whose height can vary in the course of the process. The highest and lowest position thereof is determined by a maximum vapour level thermostat 34 and a vapour level control thermostat 36 (FIG. 1). In normal operation, since the vapour level 33 is shown in a position above the control thermostat 36, the latter will come in action, whereby the heating of the liquid reservoir 2 is switched off and the vapour level 33 will drop. If the vapor level 33 drops so far that it comes below the thermostat 36, the heating is automatically switched in again. In abnormal operation, if for instance the cooling is not functioning well, the vapour level 33 will rise and could even exceed the condensation zone 15, which causes the escape of all the vapour into the ambient working space. To prevent the occurrence of this situation the maximum vapour level thermostat 34 is provided at a higher level, which thermostat reacts as soon as the vapour level line 33 has risen to that height. In that case everything is automatically switched off and the apparatus can only be switched in again by an operator after the trouble has been eliminated. This higher thermostat 34 operates therefore as a protection in the last instance.

By the creation of the vapour barrier or condensation zone 15 whose limit is determined by the vapour level line 33, no vapour can escape from the tank 1, so that the apparatus operates substantially odourless, which permits working with an open tank during the cleaning process for the easy introducing and removal of the articles to be treated. The condensate, being collected in the gutter 29, is recycled directly to the liquid bath. If water is a component of a drilling fluid applied during the cutting operation of articles or machine parts, this water must be separated from the condensate mixture of water-solvent (in which the oil component of the emulsion has already dissolved), before the other component of this mixture can be recycled to the liquid reservoir. For establishing this separation use is made of the separator 25. To this end a pipe 37 is provided between the gutter 29 and the separator 25, whereas an overflow 38 is provided for water and a discharge pipe 39 for the condensate, said latter pipe 39 opening in the reservoir 2. To expedite the separation the separator 25 is exteriorly connected between the pipes 21 and 22 of the cooling circuit.

Under some circumstances (by chimney effect) vapour threads can escape through the vapour barrier at 33. To prevent these vapour threads from getting into the ambient work space, an air exhaust system is provided. It comprises a compressor 40 connected with its suction end 41 to the air box 20. The latter surrounds the uppermost section of the tank 1 along three sides and has therefore the shape of a lying U. In the legs 20*a*, 20*b* of that U extend the heat exchangers 18*a*, *b* for outgoing heat and in the middle section 20*c* of the U extend the two branch pipes 19*a*, *b*. Vapour threads, if any, are sucked in together with ambient air through perforations 42 in the upper margin 43 (FIG. 1) of the tank 1 into the air box 20, and through the suction side 41 connected to the middle section 20*c* of the U-shaped box 20 they enter into the compressor 40 and issue on the compression side 44 thereof into the ambience again.

If the vapour degreaser in operation is put into a pit, there may be the risk that in this pit solvent vapours are concentrated during maintenance operations since the cooling system does not function and there is no vapour barrier 33. This situation could be dangerous for the maintenance operator. For that reason a suction pipe 46 is provided, whose upper end is connected to the air box 20. So when during the maintenance operations the compressor 40 is kept switched in, no undesirable situations can occur.

I claim:

1. Vapour degreasing apparatus comprising a tank having in its lower part a heatable reservoir for a solvent for fats, oils, lubricants or the like, and having, above said reservoir, a vapour space adapted for introducing therein metal articles or machine parts to be degreased, a cooling water piping being provided in the upper part of the tank, said piping comprising a section which functions as a heat exchanger for incoming heat released during the vapour-liquid conversion of the solvent while forming a vapour escape barrier for retaining through condensation the solvent vapor, said piping also comprising a section which functions as a heat exchanger for outgoing heat to the ambient air, a gutter being provided below the heat exchangers for catching the condensate, a pump connected to the cooling water piping for circulating the water, air exhaust means provided in the uppermost part of the tank for exhausting threads of vapour, if any, passing the vapour escape barrier, and for cooling that section of the cooling water piping which functions as the heat exchanger for said outgoing heat, and a water jacket in which the cooling water piping which functions as the heat exchanger for incoming heat is positioned, the cooling water piping being formed as a closed circuit without direct communication between the water coolant and the air of the outgoing heat exchanger.

2. Apparatus as claimed in claim 1, characterized in that the lower part of the inner wall of the water jacket is slanted outwards forming a recess for accommodating the gutter.

3. Apparatus as claimed in claim 1, characterized in that the pipes in the jacket are perforated and substantially parallel to each other, one being connected to the water discharge of the jacket and the other to the water supply of the jacket and being in communication with each other via said perforations through the water.

4. Apparatus as claimed in claim 3, characterized in that the perforations in the pipes are shaped as saw-cuts in the lower halves of said pipes.

5. Apparatus as claimed in claim 4, characterized in that the saw-cuts in the pipe connected to the water supply encompass, seen from the center line of the pipe, an arc of 120°, and the bisector of the arc angle is perpendicular to the slanting part of the wall.

6. Apparatus as claimed in claim 1, in which a separator is arranged near the tank to cause a separation based on a difference in specific weight between liquid solvent condensate and the watery phase of an emulsion applied to an article, said separator being connected interiorly to the gutter, and connected exteriorly to the closed circuit of the water.

7. Apparatus as claimed in claim 1 wherein the cooling water piping is located outside the tank, whereby introduction and removal of articles to be degreased is not impeded.

* * * * *